US005226539A

United States Patent [19]

Cheng

[11] Patent Number: 5,226,539

[45] Date of Patent: Jul. 13, 1993

[54] PILL CONTAINER

[76] Inventor: Lung C. Cheng, 189 Pemberton Avenue, Willowdale, Ontario, Canada, M2M 1Y9

[21] Appl. No.: 905,389

[22] Filed: Jun. 29, 1992

[51] Int. Cl.[5] ..... B65D 83/04

[52] U.S. Cl. ..... 206/534; 206/538

[58] Field of Search ..... 206/534, 538

[56] References Cited

U.S. PATENT DOCUMENTS

| | | | |
|---|---|---|---|
| 3,085,679 | 4/1963 | Burrell | 206/534 |
| 4,083,452 | 4/1978 | Rossmo | 206/534 X |
| 4,124,143 | 11/1978 | Thomas | 206/534 X |
| 5,154,296 | 10/1992 | Cutler | 206/534 |

FOREIGN PATENT DOCUMENTS

| | | | |
|---|---|---|---|
| 3530356 | 8/1986 | Fed. Rep. of Germany | 206/534 |

*Primary Examiner*—William I. Price

*Attorney, Agent, or Firm*—Mirek A. Waraksa

[57] ABSTRACT

A pill container has a lower part with eight compartments, and an upper part that rotates on the lower part. The compartments are side-by-side in a circular arrangement, and each normally contains a daily allotment of pills. The upper part carries a door, and a detent mechanism ensures that the door locates successively over each compartments. A button can be depressed to release a locking mechanism normally securing the door. A mechanical linkage simultaneously transforms axial displacement of the button into an indexing of a numbered plate relative to an indicator, effectively counting the number of times the door has been opened to remove pills. This provides an indication of the number of pills consumed. Manual rotation of the upper part to locate over a new compartment automatically resets the count. Alternatively, an electronic counter and display with appropriate switches may be used.

16 Claims, 6 Drawing Sheets

PILL CONTAINER

FIELD OF THE INVENTION

The invention relates to devices for containing and systematically dispensing pills.

BACKGROUND OF THE INVENTION

Plastic pill organizers are often supplied to geriatric patients. They are formed with multiple compartments, and a cover closing the assembly. A nurse might typically prepare a week's supply of pills in advance, placing each day's allotment of pills into a separate compartment. One problem is that patients can readily lose track of the number of pills taken, consuming pills at inappropriate intervals. Another problem is the potential to take pills from different compartments, further frustrating orderly consumption of pills.

Dispensers for birth control pills allow systematic dispensing. Many have a two-part housing. A lower part defines multiple single-dose compartments in a circular arrangement. The upper part is a lid that rotates on the lower part. A detent mechanism aligns an opening in the lid successively with each compartment for pill removal. Such dispensers may provide an indication of the day at which a particular pill is to be taken. They are fairly reliable, since absence of the single pill from any compartment immediately indicates that the daily dosage has been taken. However, they do not address problems associated with organizing and properly dispensing multiple daily doses.

SUMMARY OF THE INVENTION

In one aspect, the invention provides a pill container with a compartment for storing pills. A door accesses the compartment, and a locking mechanism normally secures the door in a closed orientation. A displaceable actuator, which is preferably a push-button, is mounted on the container. Means responsive to displacement of the actuator unlock the locking mechanism, releasing the door to allow to the pill-containing compartment. Counting means visually indicate a count and respond to displacement of the actuator by incrementing the indicated count. Since the count increments each time the door is unlocked to remove a pill, the user obtains a better indication of the number of pills he is likely to have consumed. The pill container may implement the counting function with entirely mechanical means or with a combination of mechanical and electronic components. Unless the pill container is to be disposable after a single use, means may be provided to reset the count.

In another aspect, the invention provides a pill container with a lower housing portion that defines several pill-receiving compartments in circumferentially side-by-side relationship and an upper housing portion that can be manually rotated. In an exemplary application, each compartment might be filled with a user's daily allotment of pills, and the compartments together might contain a week's supply of pills. The upper housing portion has a door for accessing the compartments, which is normally secured in a closed state by a locking mechanism. A detent mechanism resists relative rotation of the housing portions whenever the door is positioned over a different compartment. A displaceable actuator is mounted on the housing. Means responsive to the displacement of the actuator unlock the locking mechanism, permitting access to the pills in the compartment over which the door is currently positioned. Counting means visually display a pill count and respond to displacement of the actuator by incrementing the displayed count. Means are provided for resetting the count to a predetermined value in response to rotation of the upper housing portion between adjacent positions. In the exemplary application, pills are indirectly counted with releasing of the door over the compartment used on a particular day, and the count is re-set when the door is positioned over the next compartment containing another day's supply.

In a preferred mechanical implementation of the multiple-compartment pill container, the actuator is a push-button displaceable between first and second positions spaced along a predetermined axis, preferably the rotational axis of the housing portions. Biasing means normally urge the actuator to its first position. The counting means may comprise a scale member with numbers or other indicia spaced according to a predetermined angular increment and an indicator that aligns with the indicia. In response to manual displacement of the actuator, a mechanical linkage indexes the indicator relative to the scale member effectively to increment the indicated count. The detent mechanism may be adapted to permit rotation of the upper housing portion only in a single direction, and the mechanical linkage may be adapted to index the scale member, for example, in that particular direction, each time the actuator is displaced. The resetting means may then comprise a cooperating pair of stops, one fixed to the upper housing portion and the other fixed to the scale member. The stops are positioned circumferentially to contact one another as the upper housing portion is manually rotated to position its door over the next compartment. The manual rotation incidentally rotates the scale member until the indicator is positioned to indicate some predetermined initial value, typically zero.

Various aspects of the invention will be apparent from a description below of preferred embodiments and will be more specifically defined in the appended claims.

DESCRIPTION OF THE DRAWINGS

The invention will be better understood with reference to drawings in which.

Figure 1:
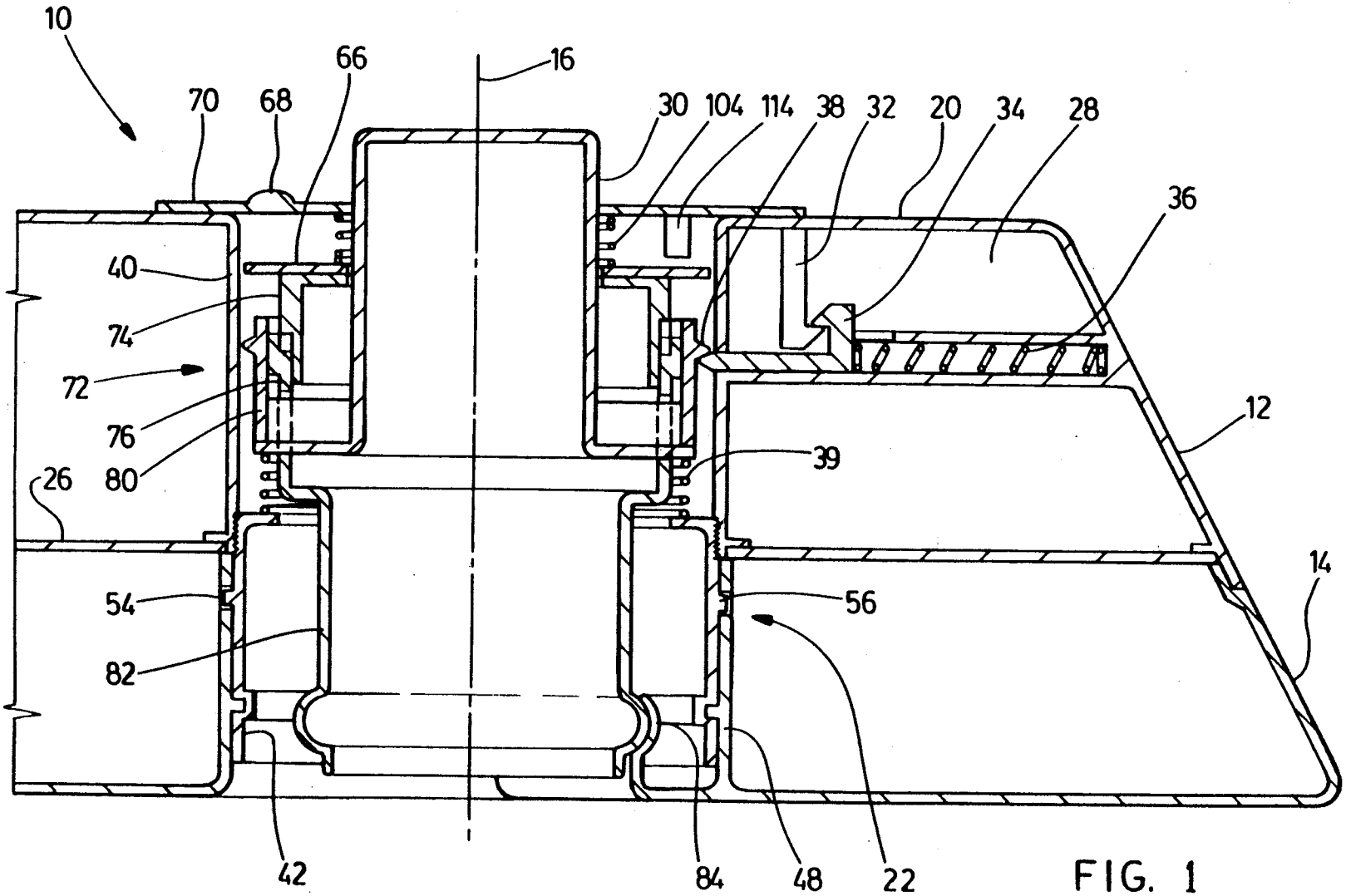
FIG. 1 is a fragmented cross-sectional view in a vertical plane through a pill container embodying the invention.
Figure 6:
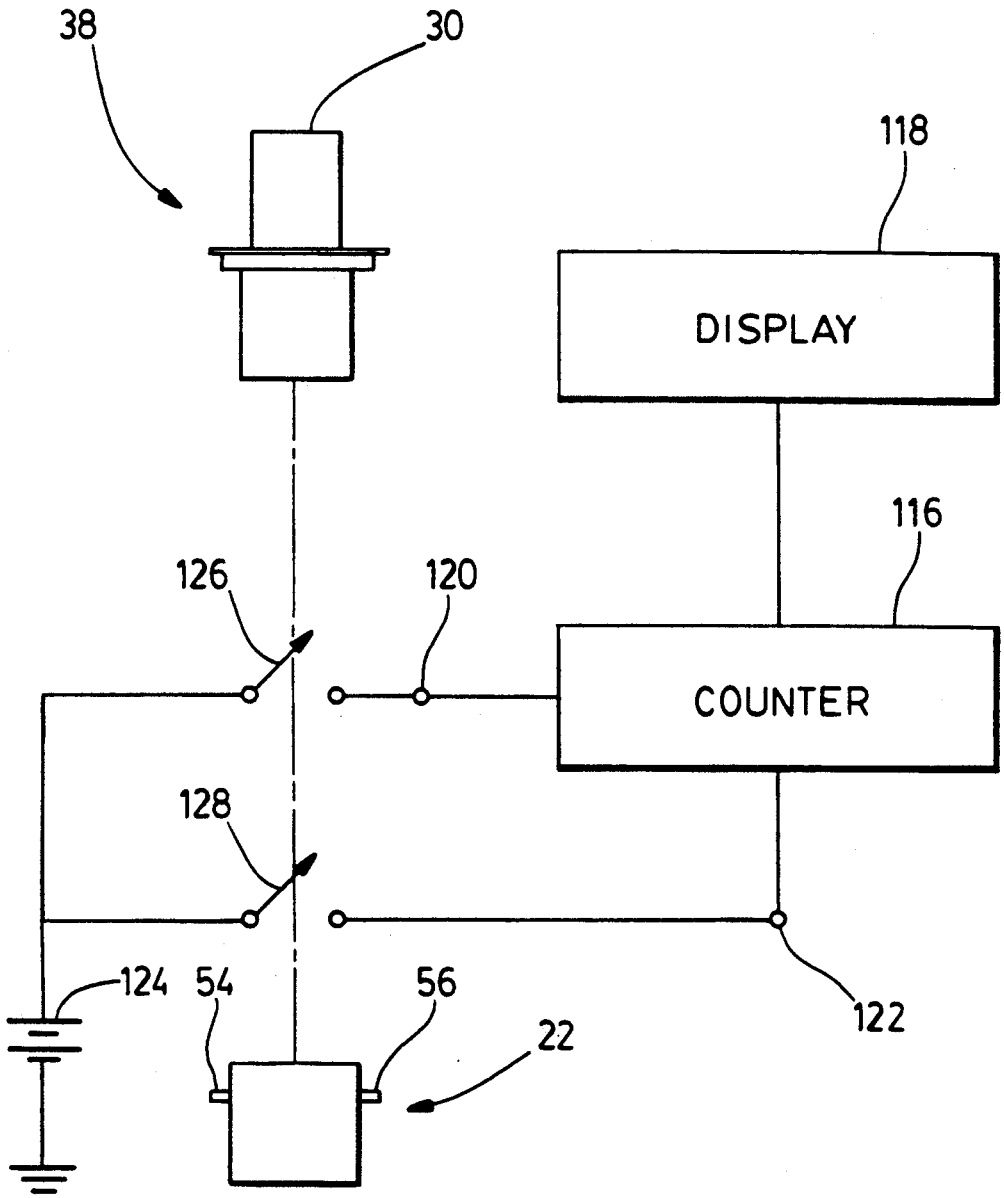

FIGS. **4*a*–4*d*** are fragmented perspective views detailing how the mechanical linkage rotates a scaled plate;

FIGS. **5*a*–5*d* illustrate how stops are used to limit the count produced by the counting mechanism and to reset the counting mechanism; and, FIG. 6 is a schematic illustration of how an alternative electronic counting mechanism that can be incorporated into the pill container of FIG. 1**.

DESCRIPTION OF PREFERRED EMBODIMENTS

Figure 2:
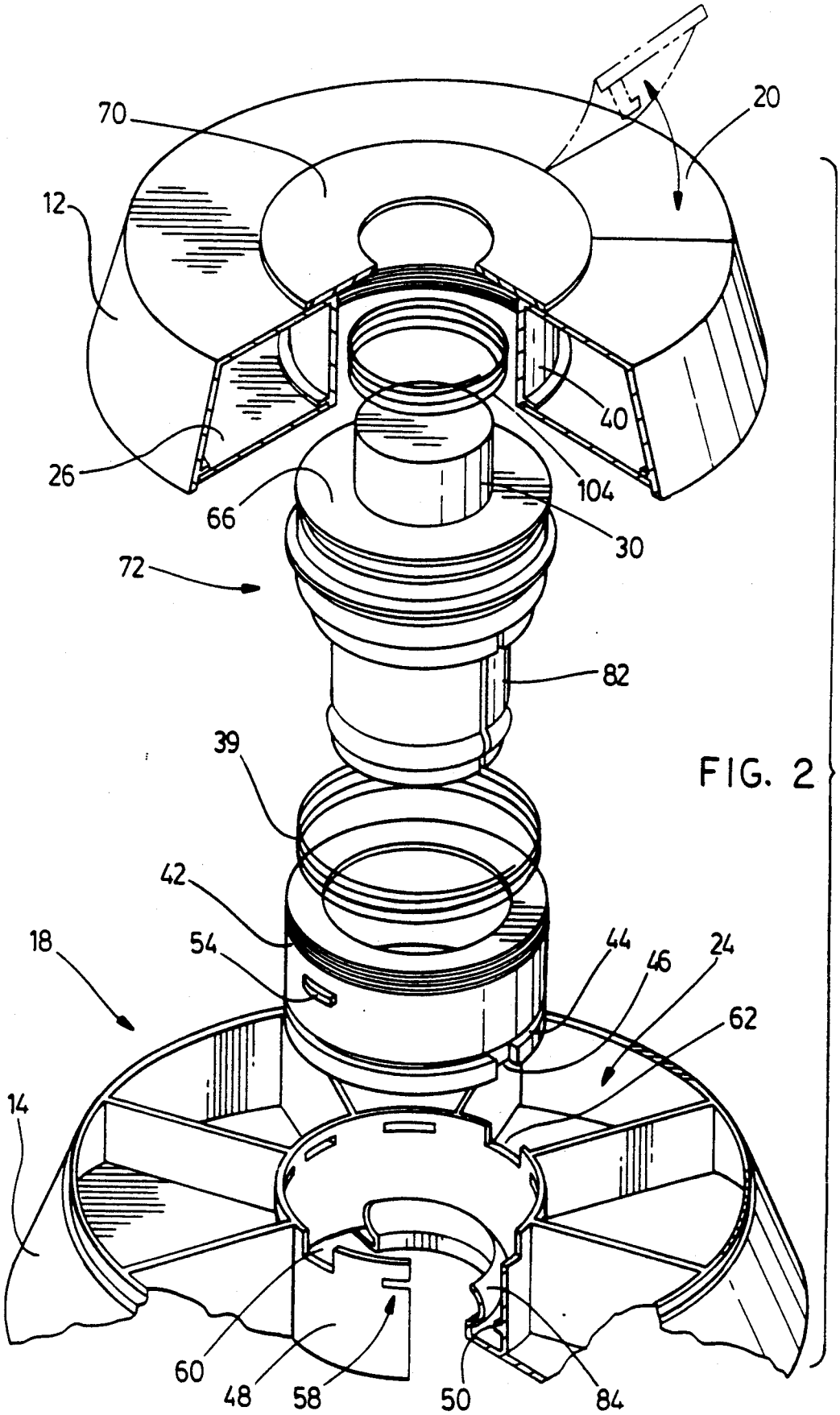
FIG. 2 is a fragmented exploded view of the pill container.
Figure 3:
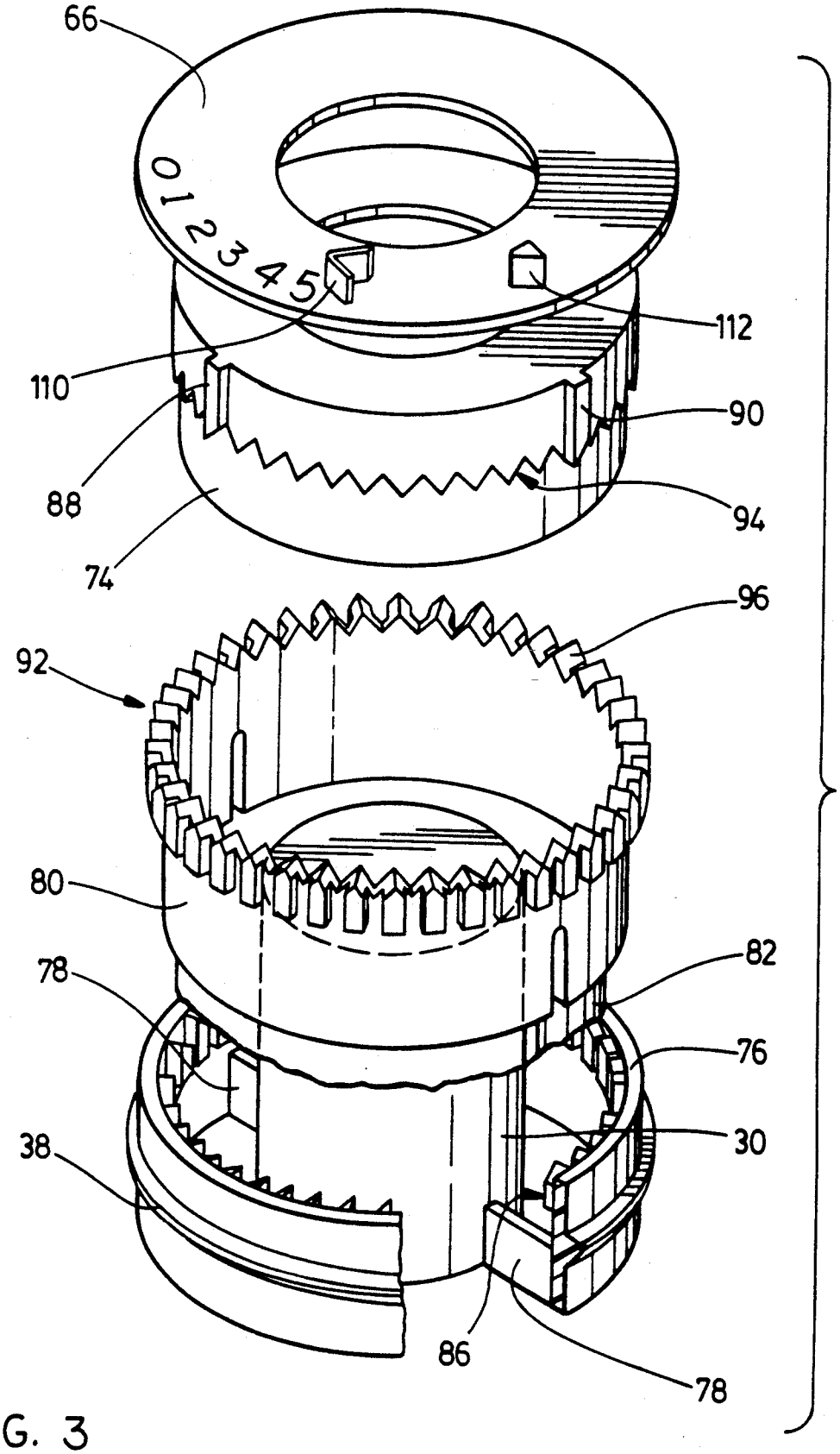
FIG. 3 is an exploded perspective view of a mechanical linkage used to transform axial displacement of an actuator into a count by a counting mechanism.

Reference is made to FIGS. 1 and 2 which illustrates a pill container 10. A brief overview of the container 10 will be provided before focussing on details of construction and operation. The container 10 comprises a housing with upper and lower housing portions 12, 14 that are joined for relative rotation about a vertical axis 16. The lower housing portion 14 has internal partitions that divide its interior into eight compartments (generally indicated with reference numeral 18 in FIG. 2) in circumferentially side-by-side relationship, each compartment spanning a 45-degree sector. The upper housing portion 12 carries a door 20 spanning roughly a 45-degree sector. A detent mechanism 22 defines eight distinct positions for the upper housing portion 12 relative to the lower housing portion 14, each position being spaced by 45 degrees, and allows the upper housing portion 12 to rotate only in a clockwise direction (as viewed from above). In each position, the door 20 is located over a different compartment. In this embodiment, seven of the compartments 18 are used to contain pills, a week's supply. When the door 20 locates over the eighth compartment 24, the upper and lower housing portions 12, 14 can be vertically separated to restock the compartments 18. The upper housing portion 12 has closure members 26 which close and isolate the various compartments 18, but allow access to the particular compartment over which the door 20 is currently located. This prevents mixing of pills if the container 10 is carried in a pocket or purse. A locking mechanism 28 releasably secures the door 20 in a closed orientation, as in FIG. 1. A spring-biased push-button actuator 30 can be depressed to release the locking mechanism 28, and the door 20 may be spring-biased in a conventional manner to immediately open, the open orientation being shown in phantom outline in FIG. 2. Such displacement of the actuator 30 simultaneously increments a pill count visually displayed by a mechanical counter.

The locking mechanism 28 apparent in FIG. 1, comprises a generally vertical member 32 fixed to the door 20 and a generally horizontal member 34 mounted for displacement horizontally within the housing in a radical direction relative to the rotational axis 16. A biasing spring 36 normally urges the horizontal member 34 to a locking state relative to the vertical member 32, as in FIG. 1, in which complementary hook portions of the two members are interlocked. If the horizontal member 34 is displaced radially away from displacement axis 16, the locking mechanism 28 is unlocked. Restoring the door 20 to its closed orientation immediately restores the locking mechanism 28 to its locked state.

A flange 38 is connected to the actuator 30 (through another member described more fully below) for axial displacement with the actuator 30. The flange 38 projects radially outwardly relative to the actuator 30. As the actuator 30 is manually displaced from an upper rest position in FIG. 1 to a lower axial position, the flange 38 momentarily displaces the horizontal member 34 radially outwardly to release the door 20. The circumferential nature of the flange 38 is significant as the door 20 and locking mechanism 28 rotate together with the upper housing portion 12. It ensures that the door 20 will open when the button is depressed regardless where the door 20 and locking mechanism 28 are positioned. The actuator 30 is urged by a large biasing spring 39 back to its uppermost position in FIG. 1 after being depressed.

A mechanism (apparent in FIGS. 1 and 2) joins the upper and lower housing portion 14 to permit not only the required relative rotation, but also vertical joining and separation when the door 20 is positioned over the eight compartment. The upper housing portion 12 has an upper central vertical sleeve 40 and an extension 42 threaded to the bottom of the sleeve 40. The extension 42 is formed with a circumferential groove 44 and a vertical groove 46 that intersects and accesses the circumferential groove 44. The lower housing portion 14 has a lower central vertical sleeve 48 dimensioned to receive the extension 42. The lower sleeve 48 has a horizontal projection 50 that locates and travels upwardly in the vertical groove 46 during vertical joining of the housing portions 12, 14. Thereafter, the horizontal projection 50 travels within the circumferential groove 44 and prevents separation of the housing portions 12, 14. Once rotated through 360 degrees, the door 20 is once again over the eighth compartment 24. The horizontal projection 50 is then positioned to be received in the vertical groove 46 and to travel along the vertical groove 46 for separation of the two housing portions 12, 14. It should be noted that another horizontal projection (not illustrated) on the lower sleeve 48 is similarly received in the circumferential groove 44 through another vertical groove (not illustrated) in the extension 42. The spacing between the two horizontal projections may be more or less than 180 degrees to provide a single removal and connecting orientation for the upper housing.

The detent mechanism 22 (apparent in FIGS. 1 and 2) comprises a pair of horizontal detent projections 54, 56 attached to the extension 42 and spaced 180 degrees apart. The lower sleeve 48 is formed with eight slots (generally indicated with reference number 58) dimensioned to receive the projections 54, 56 and evenly spaced circumferentially from one another by 45 degrees. Two slots 60, 62 spaced 180 degrees apart extend upwardly to the upper edge of the lower sleeve 48. These receive the two detent projections 54, 56 when the two housing portions 12, 14 are joined, and also allow the detent mechanism 22 to release vertically when the housing portions 12, 14 are separated. As apparent in FIG. 2, the detent projections 54 has a trailing edge (counterclockwise from above) that is bluntly terminated and otherwise terminates smooth at a clockwise extremity into the outer cylindrical surface of the extension 42. This arrangement permits the upper housing portion 12 to rotate only in a clockwise direction in 45-degree increments and defines the eight distinct positions of the upper housing portion 12 relative to the lower housing portion 14.

The mechanical counter includes a scale member 66 mounted in the central vertical sleeve 40 of the upper housing portion 12 (as apparent in FIGS. 1 and 2). The scale member 66 is essentially an annular plate with numbers 0–5 (apparent in FIGS. 5*a*–5*d*) spaced circumferentially from one another in roughly 9 degree increments (as viewed relative to the axis 16) on its upper exposed face. The total sector spanned by such indicia is roughly 45 degrees. A transparent magnifying indicator 68 is supported by a flange 70 fixed to the top of the housing. In this embodiment of the invention, the indicator 68 remains stationary while the scale member 66 actually rotates. The indicator 68 will normally be aligned with one number of the scale member 66.

A mechanical linkage 72 connects the scale member 66 to the button. The linkage 72 is apparent in FIGS. 1 and 2, and its components are detailed in FIGS. 3 and 4*a*–4*d*. Its purpose is to transform axial displacement of the actuator 30 incidental to releasing the door 20 into a nine-degree clockwise indexing of the scale member 66.

The linkage 72 has three principal components: an upper member 74 to which the scale member 66 is adhered; a lower member 76 fixed with struts 78 to the actuator 30 for axial displacement with the actuator 30 and carrying the flange 38; and an intermediate member 80 supported on a sleeve 82. The sleeve 82 is formed with an annular projection that snaps into an internal socket 84 formed at the base of the lower housing portion 14, within the lower sleeve 48. The fit is sufficiently tight to keep the intermediate member 80 stationary during indexing of the scale member 66, but to allow rotation of entire linkage 72 during resetting of the counter, as discussed more fully below. The mechanical linkage 72 is somewhat similar to a mechanism used in a conventional ball-point pen to control the position of its writing point. In a pen, however, the components are configured to lock a push-button and ink cartridge attached thereto in either of two axially-spaced positions relative to the pen housing, incidentally producing an indexing of the push-button and possibly the cartridge.

The three members are formed with vertically interleaved projections. These are identified in the exploded view of FIG. 3. The lower member 76 is formed with 40 identical, internal vertical projections (generally indicated by reference numeral 86) in a generally cylindrical arrangement with a predetermined diameter. These are equally spaced-apart circumferentially from one another by substantially 9 degrees, the angular increment between the indicia of the scale member 66. The upper member 74 is formed with only four identical external vertical projections (two such projections 88, 90 being apparent in FIG. 3). These are spaced 90 degrees apart from one another, and are shaped and positioned to interleave vertically with the internal projections 86 of the lower member 76. Because of the symmetry in shape and spacing, the upper member 74 interlocks in 40 positions relative to the lower member 76, each spaced by about 9 degrees. The intermediate member 80 is formed with 40 identical, external vertical projections (generally indicated with reference numeral 92), once again spaced apart by 9 degrees, in a generally cylindrical arrangement of the same predetermined diameter. These are always vertically interleaved to some degree with the internal projections 86 of the lower member 76. When in an uppermost axial position (as in FIG. 4*a*), the projections 86 of the lower member 76 are vertically interleaved with the projections of the upper member 74. This resists indexing of the upper member 74 and of the scale member 66. When in a lowermost axial position (as in FIG. 4*b*), the projections 86 of the lower member 76 are clear of the projections of the upper member 74, enabling indexing of the upper member 74 and scale member 66 about the axis 16.

Complementary serrated surfaces are involved in controlling the indexing of the upper member 74. These are apparent in FIG. 3. The upper member 74 has a serrated surface 94 of generally circular overall shape that faces downwardly. The surface comprises 40 serrations of generally triangular appearance, each spanning roughly 9 degrees. The intermediate member 80 defines a complementary serrated surface 96 that face upwards.

The movement of one projection 90 of the upper member 74 in response to axial displacement of the actuator 30 is illustrated in FIGS. 4*a*–4*d*. It should be understood that the other three projections are simultaneously displaced in a similar manner.

Figure 4B:
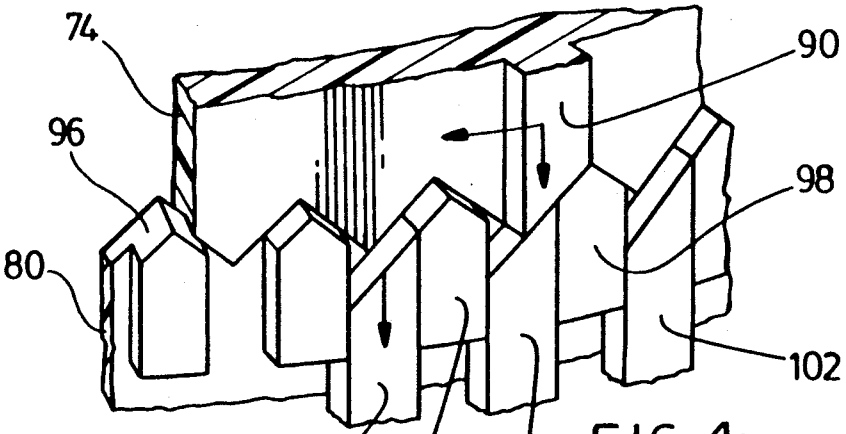
Figure 4A:
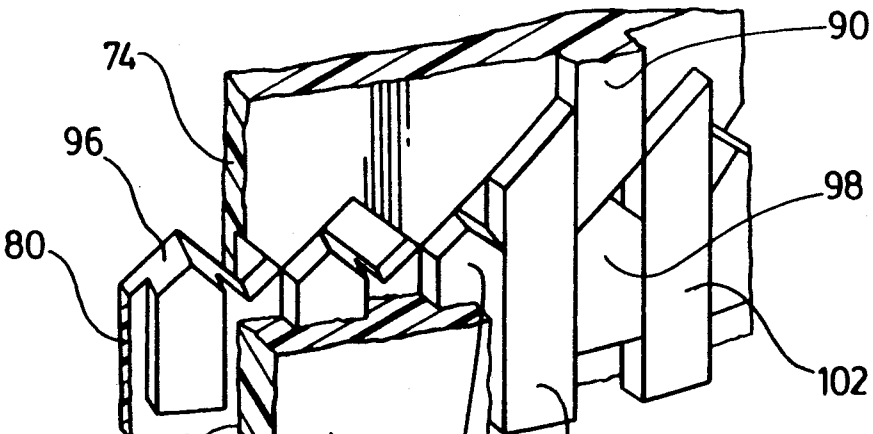

In FIG. 4*a*, the lower member 76 and the actuator 30 are in their uppermost axial positions. The projection 90 of the upper member 74 is supported vertically on one projection 98 of the intermediate member 80. The lower surface of the supported projection 90 is inclined at 45 degrees, and the upper surface of the supporting projection 98 has a supporting surface portion at the same angle. The supporting projection 98 consequently urges the supported projection 90 to index clockwise and to displace downwardly. The supported projection 90 of the upper member 74 is, however, interleaved vertically with a pair of projections 100, 102 of the lower member 76, which resist such indexing and downward displacement. The supported projection 90 is consequently in a stable rest position.

As the actuator 30 is displaced from its upper position to its lower position, compressing the biasing spring 39, the pair of projections 100, 102 of the lower member 76 no longer remain interleaved with the supported projection 90. Contact with the upper surface of the supporting projection 98 of the intermediate member 80 results in a downward displacement and clockwise indexing of the supported projection 90, as in FIG. 4*b*. Although such action might occur under the influence of gravity, a biasing spring 104 acting between the housing and the scale member 66 is used to urge the upper member 74 downwardly toward the intermediate and lower members. The serrated surface 94 simultaneously mates with the serrated surface 96, limiting such indexing and displacement. Specifically, the indexing is stopped when the supported projection 90 of the upper member 74 is positioned vertically over the immediately adjacent projection 100 of the lower member 76.

Figure 4D:
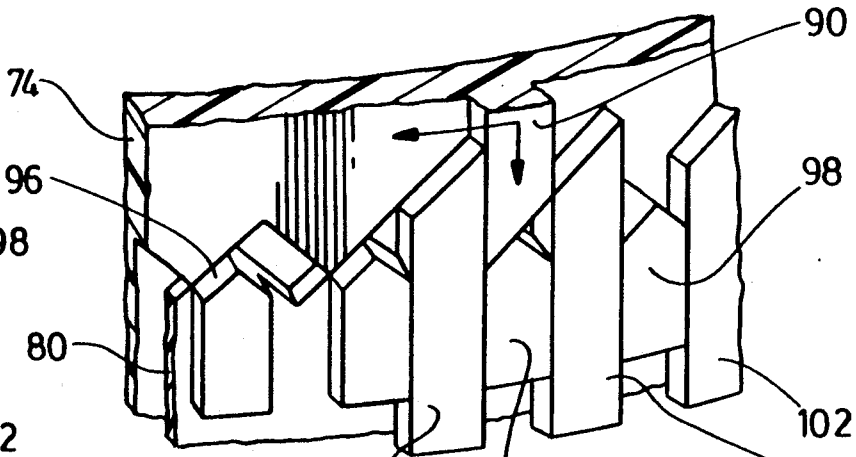
Figure 4C:
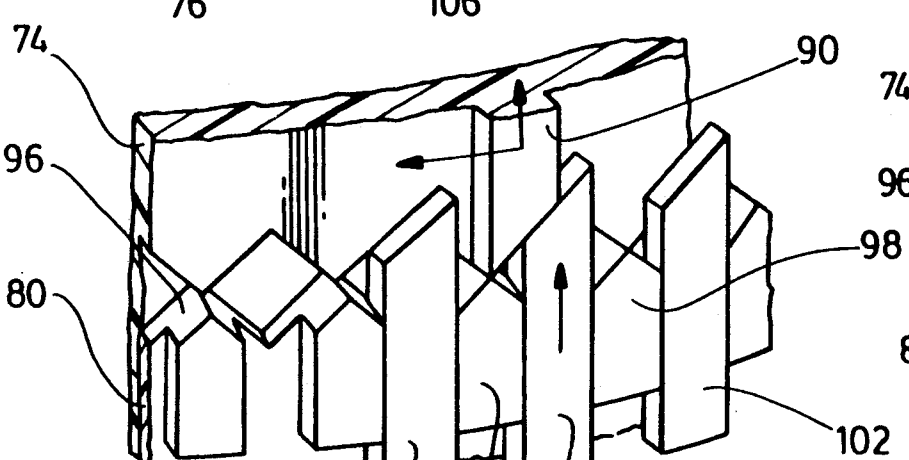

The required 9-degree indexing of the upper member 74 is completed with the upstroke of the actuator 30 under the influence of its biasing spring 39, as illustrated in FIGS. 4*c* and 4*d*. The projection 100 of the lower member 76 has an upper surface inclined at 45 degrees. As the projection 100 rises with the lower member 76 back to its uppermost position, it displaces the supported projection 90 upwardly and simultaneously urges the supported projection 90 to index clockwise until it locates over an immediately adjacent projection 106 of the intermediate member 80. As the upward movement of the actuator 30 continues, the supported projection 90 interleaves vertically with the vertical projection 100 and the next vertical projection 108 of the lower member 76, arriving eventually at another a stable resting position.

The counter is reset when the upper housing portion 12 is indexed through 45 degrees clockwise to locate the door 20 over an immediately adjacent compartment. The resetting mechanism includes a pair of V-shaped stops 110, 112 that are fixed to the scale member 66. These are spaced circumferentially by 45 degrees, that angle corresponding to the maximum count times the indexing increment of 9 degrees and to the sector angle of each compartment. Another stop is fixed to the upper housing portion 12, specifically to the underside of the flange 70 supporting the indicator 68. It is located circumferentially between the pair of stops 110, 112 of the scale member 66.

Figure 5A:
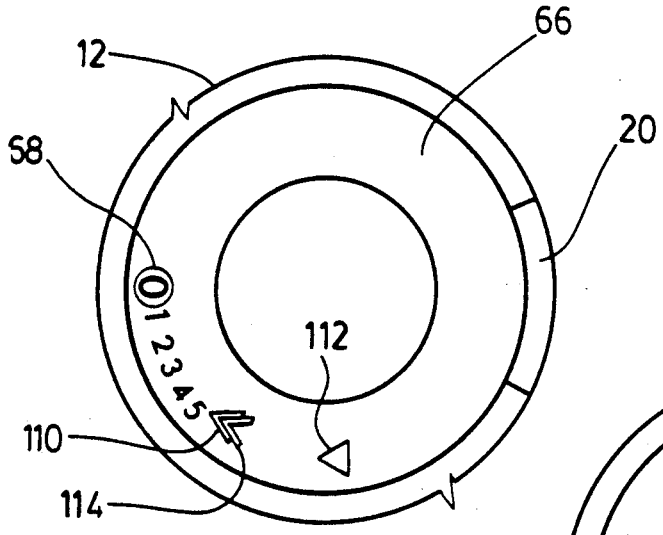
Figure 5B:
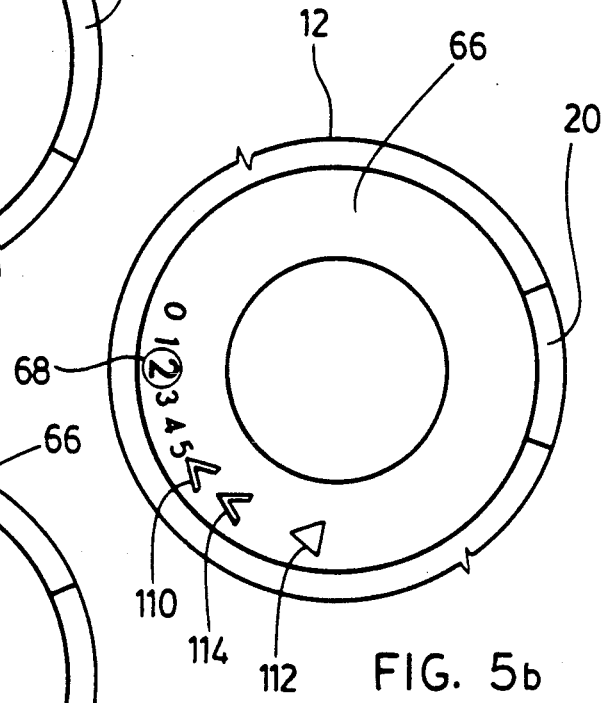

Count limiting and resetting functions will be explained with reference to FIGS. 5*a*–5*d*. In FIG. 5*a*, a fragment of the door 20 is shown positioned over one compartment and the counter is set to zero. FIG. 5*b* shows the scale member 66 indexed twice, each time by 9 degrees, following displacement of the actuator 30 twice. The rightmost stop 112 has advanced clockwise by 18 degrees toward the stationary stop of the housing.

Figure 5C:
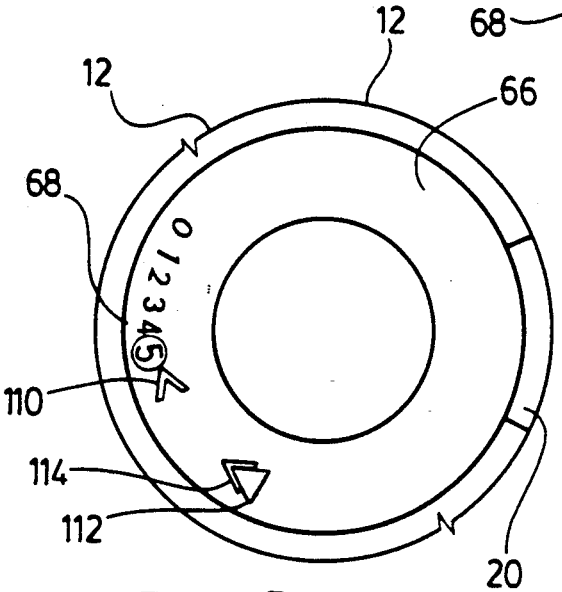

If the actuator 30 is depressed three more times, the orientation of FIG. 5*c* is achieved, in which the rightmost stop 112 on the scale member 66 has indexed clockwise through 45 degrees and abuts the stationary stop 114 of the housing. This engagement of the two stops resists further incrementing of the counter and opening of the door 20, constraining the maximum count to five.

Figure 5D:
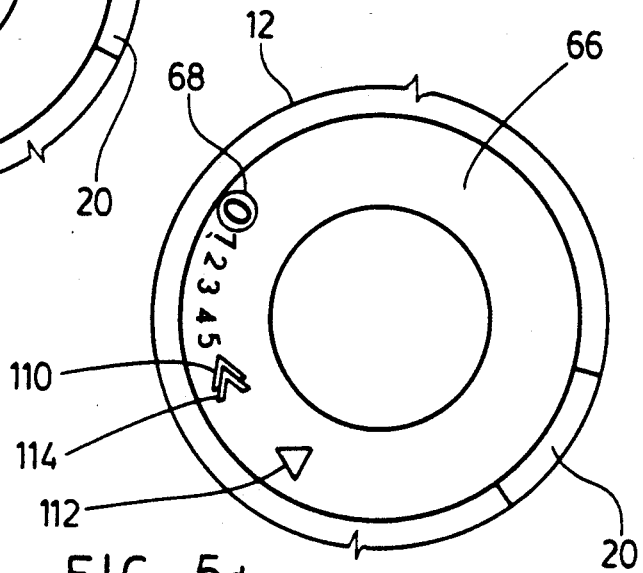

The counter is shown reset in FIG. 5*d*. The upper housing portion 12 has been manually rotated clockwise through 45 degrees, as will be apparent from the new position of its door 20. If the resetting is performed from the orientation of FIG. 5*c* in which the maximum count has been achieved, the indicator 68 simply rotates with the upper housing portion 12 through 45 degrees and positions over number "0" on the scale member 66. The rightmost stop 112 of the scale member 66 is once again spaced 45 degrees from the stop of the housing, and another maximum count of 5 is possible. The mechanical linkage 72 and the scale member 66 remain stationary during resetting, but only because the scale member 66 has been indexed through to its maximum count.

The importance of the leftmost stop 110 is much more apparent if resetting is considered, for example, from the orientation of FIG. 5*b* in which a count of only 2 has been reached. In the process of rotating the upper housing portion 12 through 45 degrees, its stop 114 is initially rotated through 18 degrees, clockwise, until it abuts the leftmost stop 110 of the scale member 66. As the upper housing portion 12 and its stop 114 are then manually rotated through the remaining 27 degrees required to orient the door 20 over the next compartment, the housing stop 114 rotates the scale member 66 by engagement with its leftmost stop 110 through the same number of degrees. In this instance, the mechanical linkage 72 is rotated in the socket 84 at the base of the lower housing portion 14. This once again results in the overall reset orientation of FIG. 5*d*.

FIG. 6 schematically illustrates an alternative electronic counting mechanism that can be incorporated into the device of FIG. 1. The electronic mechanism includes a conventional electronic counter 116 that controls a liquid crystal display 118. The display 118 may be mounted on the upper surface of the upper housing portion 12. The counter 116 includes a count-incrementing terminal 120 and a resetting terminal 122, to which triggering signals are applied. Two switches are used to apply the required triggering signals from a battery 124 that otherwise powers the counter 116 and display 118. The first switch 126 may simply be positioned on the extension 42 to be contacted by the actuator 30 in its lowermost position, and appropriate stops and guides may be provided to control travel of the actuator 30. Alternatively, the switch 126 may be constituted by a pair of contacts attached to the door 20 and the upper housing portion 12 such that the contacts open and close with the door 20. The other switch 128 applies a reset pulse to the counter 116 whenever the upper housing portion 12 is indexed through 45 degrees. That switch 128 may be constituted by conductive contacts on the projections 54, 56 of the detent mechanism, and a conductive cylindrical surface in the interior of the lower sleeve 48 about its slot 58, which couples the projection 54, 56 during indexing between successive positions of the upper housing portion 12.

It will be appreciated that particular embodiments of the invention has been described and that modifications may be made therein without departing from the spirit of the invention or necessarily departing from the scope of the appended claims.

I claim:

1. A pill container comprising:

a housing with a compartment for storing pills;

a door for accessing the compartment, the door having open and closed orientations;

a locking mechanism having a locked state in which the locking mechanism secures the door in its closed orientation and unlocking state in which the locking mechanism releases the door for displacement to its open orientation;

an actuator displaceable relative to the housing;

means responsive to displacement of the actuator for placing the locking mechanism in its unlocking state;

counting means visually indicating a count, the counting means comprising coupling means responsive to the displacement of the actuator for incrementing the count;

whereby, each time the actuator is displaced to release the door, the counter increments its counts.

2. The pill container of claim 1 in which:

the actuator is displaceable along a predetermined axis between a first position and a second position;

biasing means urge the actuator toward its first position;

the counting means comprise a scale member bearing indicia circumferentially spaced by a predetermined angular increment and an indicator aligned with one of the indicia identifying the count; and, the coupling means comprise a mechanical linkage connecting one of the scale member and the indicator to the actuator such that axial displacement of the actuator between its first and second positions indexes the one of the scale member and the indicator relative to the other by the predetermined angular increment thereby to increment the visually-indicated count.

3. The pill container of claim 2 in which the mechanical linkage comprises:

a lower member formed with a multiplicity of vertical projections in a generally cylindrical arrangement of predetermined diameter and equally spaced-apart circumferentially according to the predetermined angular increment, the lower member being secured to the actuator for vertical displacement with the actuator along the predetermined axis;

an upper member surrounding the actuator and formed with a plurality of projections, the projections of the upper member being spaced and shaped to interleave vertically with the projections of the lower member, the upper member being attached to one of the scale member and the indicator, the other of the scale member and the indicator being fixed to the housing; and, an intermediate member surrounding the actuator and secured to the housing against axial displacement, the intermediate member being positioned axially between the upper and lower members, the intermediate member comprising a multiplicity of vertical projections in a generally cylindrical arrangement of the predetermined diameter and equally spaced-apart circumferentially according to the predetermined angular increment, the projections of the intermediate member being vertically interleaved with the projections of the lower member;

each of the projections of the upper member being supported on a different one of the projections of the intermediate member and being interleaved vertically with a pair of the projections of the lower member surrounding the supporting projection of the intermediate member when the lower member is in an upper position;

the lower member displacing to a lower position in which the projections of the upper member are no longer vertically interleaved with the projections of the lower member in response to axial displacement of the actuator to its second position;

each of the projections of the intermediate member being shaped to urge any supported one of the projections of the upper member to index in a predetermined direction and to displace downwardly when the supported projection of the upper member is no longer vertically interleaved with the projections of the lower member;

the upper member defining a serrated surface which is generally circular and faces downwardly and the intermediate member defining a serrated surface which is generally circular and faces upwardly, the serrated surfaces being shaped and positioned to mate to resist the indexing and downwardly displacement of the projections of the upper members when each of the projections of the upper member positions vertically over an immediately adjacent one of the projections of the lower member;

each of the projections of the lower member being shaped to displace any projection of the upper member vertically positioned over the projection of the lower member upwardly and to index the said projection of the upper member in the predetermined direction in response to displacement of the lower member to its upper position to a position over an immediately adjacent one of the projections of the intermediate member and interleaved between a pair of projections of the lower member.

4. The pill container of claim 3 in which the mechanical linkage comprises a biasing spring acting between the housing and the upper member to urge the upper member toward the intermediate member.

5. The pill container of claim 1 in which:

the counting means comprise an electronically controllable display and an electronic counter operably coupled to the display, the counter have a count-incrementing terminal and a count-resetting terminal; and, the coupling means comprise first switching means for applying a triggering signal to the count-incrementing signal in response to the displacement of the actuator and second switching means for applying a triggering signal to the count-resetting terminal.

6. A pill container comprising:

a housing comprising a lower housing portion defining a multiplicity of pill-receiving compartments in circumferentially side-by-side relationship and an upper housing portion shaped to close and separate the compartments;

a door secured to the upper housing portion and having open and closed orientations;

a locking mechanism secured to the upper housing portion, the locking mechanism having a locked state in which the locking mechanism secures the door in its closed orientation and unlocked state in which the locking mechanism releases the door for displacement to its open orientation;

joining means releasably joining the upper housing portion to the lower housing portion for manual rotation about a predetermined axis, the joining means comprising detent means for resisting relative rotation of the upper and lower housing portions whenever the upper housing portion is in any one of a multiplicity of predetermined positions relative to the lower housing portion, each of the predetermined positions corresponding to location of the door over a different one of the compartments;

an actuator displaceable relative to the housing;

means responsive to displacement of the actuator for unlocking the locking mechanism to release the door;

counting means for visually indicating a count, the counting means comprising coupling means responsive to displacement of the actuator for incrementing the count; and, means for resetting the count to a predetermined value in response to rotation of the upper housing between adjacent ones of its positions relative to the lower housing portion.

7. The pill container of claim 6 in which the joining means are adapted to permit vertical separation and rejoining of the upper and lower housing portions when the upper housing portion is manually rotated to a predetermined one of its multiplicity of positions relative to the lower housing portion, the joining means comprising:

a circumferential groove in one of the upper and lower housing portions;

a horizontal projection attached to the other of the upper and lower housing portions, the horizontal projection being located within the circumferential groove and shaped to displace along the circumferential groove; and, a vertical groove formed in the one of the upper and lower housing portions and intersecting the circumferential groove, the vertical groove being positioned to receive the horizontal projection from the circumferential groove when the upper housing portion is in the predetermined one of its relative positions and being shaped to permit vertical displacement of the horizontal projection to and from the circumferential groove.

8. The pill container of claim 6 in which:

the actuator is displaceable along the predetermined axis between first and second axially-spaced positions; and, biasing means urge the actuator to its first axial position.

9. The pill container of claim 8 in which:

the counting means comprise a scale member bearing indicia circumferentially spaced by a predetermined angular increment and an indicator aligned with one of the indicia identifying the count; and, the coupling means comprise a mechanical linkage connecting one of the scale member and the indicator to the actuator such that axial displacement of the actuator between its first and second positions indexes the one of the scale member and the indicator relative to the other of the scale member and the indicator by the predetermined angular increment thereby to increment the visually-indicated count.

10. The pill container of claim 9 in which:

the detent means permit rotation of the upper housing relative to the lower housing only in a predetermined direction and the mechanical linkage indexes the one of the scale member and the indicator in the predetermined direction;

the resetting means comprise a first stop fixed to the one of the scale member and the indicator and a second stop fixed to the upper housing portion; and, the second stop is positioned to engage the first stop in response to rotation of the upper housing portion from any one of its multiplicity of relative positions to an adjacent one of its multiplicity of relative positions thereby to rotate the one of the scale member and the indicator until the indicator is positioned to indicate the predetermined value.

11. The pill container of claim 10 comprising:

means for stopping incrementing of the count when a predetermined maximum value is indicated by the indicator, each of the compartments being contained within a sector of the lower housing portion spanning a sector angle that corresponds to the predetermined maximum value times the predetermined angular increment.

12. The pill container of claim 11 in which the means for stopping he count comprise a third stop attached to the one of the scale member and the indicator and circumferentially spaced from the first stop by substantially the sector angle.

13. The pill container of claim 8 in which the mechanical linkage comprises:

a lower member formed with a multiplicity of vertical projections in a generally cylindrical arrangement of predetermined diameter and equally spaced-apart circumferentially according to the predetermined angular increment, the lower member being secured to the actuator for vertical displacement with the actuator along the predetermined axis;

an upper member surrounding the actuator and formed with a plurality of projections, the projections of the upper member being spaced and shaped to interleave vertically with the projections of the lower member, the upper member being attached to one of the scale member and the indicator, the other of the scale member and the indicator being fixed to the housing; and an intermediate member surrounding the actuator and secured to the housing against axial displacement, the intermediate member being positioned axially between the upper and lower members, the intermediate member comprising a multiplicity of vertical projections in a generally cylindrical arrangement of the predetermined diameter and equally spaced-apart circumferentially according to the predetermined angular increment, the projections of the intermediate member being vertically interleaved with the projections of the lower member;

each of the projections of the upper member being supported on a different one of the projections of the intermediate member and being interleaved vertically with a pair of the projections of the lower member surrounding the supporting projection of the intermediate member when the lower member is in an upper position;

the lower member displacing to a lower position in which the projections of the upper member are no longer vertically interleaved with the projections of the lower member in response to axial displacement of the actuator to its second position;

each of the projections of the intermediate member being shaped to urge any supported one of the projections of the upper member to index in a predetermined direction and to displace downwardly when the supported projection of the upper member is no longer vertically interleaved with the projections of the lower member;

the upper member defining a serrated surface which is generally circular and faces downwardly and the intermediate member defining a serrated surface which is generally circular and faces upwardly, the serrated surfaces being shaped and positioned to mate to resist the indexing and downwardly displacement of the projections of the upper members when each of the projections of the upper member positions vertically over an immediately adjacent one of the projections of the lower member;

each of the projections of the lower member being shaped to displace any projection of the upper member vertically positioned over the projection of the lower member upwardly and to index the said projection of the upper member in the predetermined direction in response to displacement of the lower member to its upper position to a position over an immediately adjacent one of the projections of the intermediate member and interleaved between a pair of projections of the lower member.

14. The pill container of claim 13 in which the mechanical linkage comprises a biasing spring acting between the housing and the upper member to urge the upper member toward the intermediate member.

15. The pill container of claim 8 in which:

the locking mechanism comprises a member displaceable radially away from the predetermined axis to release the door and a biasing spring urging the member toward the axis; and, the actuator supports an annular member that surrounds the actuator and displaces axially with the actuator, the annular member being positioned to engage and displace the member of the locking mechanism radially away from the axis in response to displacement of the actuator from its first axial position to its second axial position.

16. The pill container of claim 6 in which:

the counting means comprise an electronically controllable display and an electronic counter operably coupled to the display, the counter have a count-incrementing terminal and a count-resetting terminal;

the coupling means comprise first switching means for applying a triggering signal to the count-incrementing signal in response to the displacement of the actuator and second switching means for applying a triggering signal to the count-resetting terminal in response to manual rotation of the upper housing portion between adjacent ones of its position relative to the lower housing portion.

* * * * *